United States Patent [19]

Johnson et al.

[11] Patent Number: 4,492,624

[45] Date of Patent: Jan. 8, 1985

[54] DUOCRACKING PROCESS FOR THE PRODUCTION OF OLEFINS FROM BOTH HEAVY AND LIGHT HYDROCARBONS

[75] Inventors: Axel R. Johnson, North Babylon, N.Y.; Swami Narayanan, Westwood, Mass.; Herman N. Woebcke, Stamford, Conn.

[73] Assignee: Stone & Webster Engineering Corp., Boston, Mass.

[21] Appl. No.: 431,588

[22] Filed: Sep. 30, 1982

[51] Int. Cl.[3] ..... C10G 9/14; C10G 51/06

[52] U.S. Cl. ..... 208/78; 208/72; 208/130; 585/648; 585/652

[58] Field of Search ..... 208/72, 78, 130, 132; 585/648, 652

[56] References Cited

U.S. PATENT DOCUMENTS

| | | | |
|---|---|---|---|
| 2,076,855 | 4/1937 | Mekler | 208/78 |
| 2,149,860 | 3/1939 | Morrell | 208/72 |
| 2,653,903 | 9/1953 | Kilpatrick | 208/72 |
| 2,890,256 | 6/1959 | King | 260/683 |
| 2,928,886 | 3/1960 | Nisbet et al. | 260/683 |
| 2,943,994 | 7/1960 | McCain, Jr. | 208/48 |
| 3,579,438 | 5/1971 | Cruse | 208/130 |
| 3,579,601 | 5/1971 | Kivlen | 260/683 |
| 3,641,183 | 2/1972 | Cahn et al. | 208/107 |
| 3,676,519 | 7/1972 | Dorn et al. | 208/48 Q |
| 3,711,568 | 1/1973 | Cooper | 260/683 R |
| 3,842,122 | 10/1974 | Wolk et al. | 208/48 Q |
| 3,878,088 | 4/1975 | Nahas et al. | 208/5 D |
| 3,907,661 | 9/1975 | Gwyn et al. | 208/48 Q |
| 4,002,556 | 1/1977 | Satchell, Jr. | 208/108 |
| 4,021,501 | 5/1977 | Dyer et al. | 260/683 R |
| 4,097,544 | 6/1978 | Hengstebeck | 208/78 |
| 4,268,375 | 5/1981 | Johnson et al. | 208/72 |
| 4,426,278 | 1/1984 | Kosters | 208/132 |

FOREIGN PATENT DOCUMENTS

| | | | |
|---|---|---|---|
| 2262607 | 7/1973 | Fed. Rep. of Germany . | |
| 1241052 | 11/1959 | France . | |
| 1348293 | 11/1963 | France . | |
| 1596939 | 7/1970 | France | 585/648 |
| 7605485 | 11/1977 | Italy . | |
| 41-19886 | 11/1966 | Japan . | |
| 2065203 | 11/1975 | Japan | 585/648 |
| 0789049 | 1/1958 | United Kingdom . | |
| 0886006 | 11/1959 | United Kingdom . | |
| 1049046 | 11/1966 | United Kingdom | 585/648 |
| 1253771 | 11/1971 | United Kingdom . | |
| 1292789 | 10/1972 | United Kingdom . | |
| 1309309 | 3/1973 | United Kingdom . | |

*Primary Examiner*—Curtis R. Davis
*Assistant Examiner*—Lance Johnson
*Attorney, Agent, or Firm*—Hedman, Gibson, Costigan & Hoare

[57] ABSTRACT

The invention is a method for cracking heavy oils to olefins. In parallel streams, the heavy stream and a steam diluent are heated to the point of partial thermal cracking while in the other stream a lighter oil and steam are cracked to produce olefins. The hot, olefinic light stream is then mixed with the heated heavy stream and further cracked. The hot, olefinic stream acts as both a diluent and a heat source for cracking the heavy oil to an olefin containing product.

6 Claims, 2 Drawing Figures

DUOCRACKING PROCESS FOR THE PRODUCTION OF OLEFINS FROM BOTH HEAVY AND LIGHT HYDROCARBONS

BACKGROUND OF THE INVENTION

Cross Reference to Related Applications

This application is related to PROCESS FOR PRODUCTION OF AROMATICS (BTX) FROM HEAVY HYDROCARBONS (filed Oct. 20, 1982 Ser. No. 06/435,608). (Swami Narayanan, Herman N. Woebcke and Axel R. Johnson) filed coincidentally with this application as a result of a common development effort.

FIELD OF THE INVENTION

This invention relates generally to thermal cracking of hydrocarbons to produce olefins. More particularly, the invention relates to cracking heavy hydrocarbons such as naphtha, kerosene, atmospheric gas oil, vacuum gas oil and resid to produce olefins. Most specifically, the invention relates to the use of cracked light hydrocarbons as a diluent and heat source for cracking heavy hydrocarbons.

DESCRIPTION OF THE PRIOR ART

At present, there are a variety of processes available for cracking heavy hydrocarbons to produce olefins. Typically, the hydrocarbon to be cracked is delivered to a furnace comprised of both a convection and radiant zone or section. The hydrocarbon is initially elevated in temperature in the convection zone and thereafter delivered to the radiant zone wherein it is subjected to intense heat from radiant burners. An example of a conventional furnace and process is shown in U.S. Pat. No. 3,487,121 (Hallee). After cracking, the effluent is rapidly quenched to terminate the cracking reactions.

It is also now well known that steam is used as a diluent in cracking hydrocarbons. The dilution steam reduces the mixture molecular weight and reduces the hydrocarbon partial pressure in the cracking coils. The reduced partial pressure inhibits the formation of undesirable coke products on the interior of the radiant tubes. In addition increasing dilution steam increases yield of desirable components during cracking. On the other hand, the use of steam in the hydrocarbon stream requires larger furnace capacity and equipment than would be necessary for the hydrocarbon without steam. Further, when steam is used, energy and equipment must be provided to generate and superheat the steam. In balance, the economic optimum has favored operation at minimum steam-to-hydrocarbon ratio.

In the past, light hydrocarbons were generally used to produce olefins in the thermal cracking process. In general, light hydrocarbons can be cracked with dilution steam in the range of 0.3 to 0.6 pound of steam per pound of hydrocarbon. More recently, the demand for olefins has exceeded the availability of light hydrocarbons. Thus, the industry has turned to heavier hydrocarbons as a feedstock for olefin production. It has been found that a greater quantity of dilution steam is required for the heavier hydrocarbons than for the lighter hydrocarbons. It has been found that the heavy hydrocarbons require from about 0.7 to 1.0 pound of dilution steam per pound of hydrocarbon. As a general proposition, the higher quantities of dilution steam are needed for heavier hydrocarbons to obtain the desired partial pressure of the hydrocarbon stream which is required to suppress the coking rates in the radiant coils during thermal cracking. Correlatively, the dilution steam requirement demands increased furnace size and greater utility usage.

The industry has, in the past, suggested diluents other than steam in thermal cracking. For example, in U.S. Pat. No. 4,021,501 (Dyer) the use of butene as a diluent in the cracking process is suggested. In U.S. Pat. No. 4,002,556 (Satchell) the suggestion is made that a hydrogen donor diluent be used. Therein, the hydrogen donor is a material that has been partially hydrogenated and readily gives up hydrogen under thermal cracking conditions. This material is injected into the cracking unit at a plurality of points to maintain the ratio of hydrogen transfer to the ratio of cracking at a substantially uniform level through the unit.

The industry has also used hydrocarbon as a quench material for direct quench of the pyrolysis effluent. In U.S. Pat. No. 2,928,886 (Nisbet), cracked gas effluent is quenched by direct contact with an oil-water emulsion (5%-15% oil). Further, the use of aromatic hydrocarbons and gas oils as a quench oil to increase the olefin yield of cracked feedstocks is known. In French Pat. No. 1349293 (Metallgesellschaft), and Japanese No. 41/19886 (Sumitomo Chemical) that basic concept is disclosed.

Very recently a process has been developed for cracking a light hydrocarbon under high severity conditions and thereafter coincidentally quenching the cracked effluent with a heavy hydrocarbon and cracking the heavy hydrocarbon quench at low severity by use of the sensible heat from the cracked effluent. U.S. Pat. No. 4,268,375 (Johnson).

In all of the processes known, there is no process in which heavy hydrocarbon is initially partially cracked with a minimal amount of dilution steam and thereafter cracked to completion at high severity conditions using cracked light hydrocarbon effluents as a diluent.

SUMMARY OF THE INVENTION

It is an object of the present invention to provide a process in which heavy hydrocarbon can be cracked using a minimal amount of dilution steam, i.e., one in which the dilution steam is well below the conventional 0.7 to 1.0 pound of steam per pound of hydrocarbon.

It is another object of the present invention to crack heavy hydrocarbon and light hydrocarbon in a combined process.

It is a further object of the present invention to provide a process in which light hydrocarbon is cracked essentially to its maximum conversion at a high coil outlet temperature and heavy hydrocarbon is simultaneously cracked to an intermediate stage and thereafter the cracked light hydrocarbon effluent is joined with the partially cracked heavy hydrocarbon effluent to serve as the diluent for the heavy hydrocarbon.

It is a still further object of the present invention to provide a process for cracking heavy hydrocarbons in which the equipment size, and the utility requirements, for the process is reduced below that presently required to crack heavy hydrocarbon without a loss in yield of desirable olefins when compared to conventional cracking at high steam dilutions.

It is another and further object of the present invention to provide substantial utility reduction, savings in installation costs due to reduced service area requirements, and minimization of associated dilution steam generation equipment.

To this end, a process and apparatus are provided to crack light hydrocarbon feedstock and heavy hydrocarbon feedstock in a combined system.

The light hydrocarbon feedstock is cracked in a first stage conventionally, with the customary requisite amount of dilution steam. Cracking of the light hydrocarbon feedstock proceeds by first providing dilution steam and elevating the temperature of the feedstock in the convection section of a furnace and thereafter cracking the light hydrocarbon feedstock to maximum conversion in the radiant zone of the furnace.

At the same time, the heavy hydrocarbon feedstock is provided with a minor amount of dilution steam and elevated in the convection zone of a furnace to a temperature in the range of 1000° F. Thereafter, the heavy hydrocarbon feedstock is partially cracked in a radiant zone at temperatures above 1100° F. and up to 1450° F.

The light hydrocarbon feedstock cracked at high conversion and the partially cracked heavy hydrocarbon feedstock are combined. Further cracking of the heavy hydrocarbon can take place in one of several modes:

(i) in the radiant zone—under direct firing control
(ii) in the radiant zone—but away from the direct line of radiant exposure
(iii) adiabatically—totally insulated from radiant and convection contribution, may be external to the furnace, and
(iv) by any combinations of these modes.

In the common line, the cracked pyrolysis gas from the light feedstock is, in effect, quenched to terminate or reduce the reactions of the light effluent. Simultaneously, the heat from the light hydrocarbon feedstock cracked at high conversion provides additional heat to further crack the heavy hydrocarbon feedstock.

The furnace design developed for the process employs a section of the furnace suited to partially crack the heavy hydrocarbon feedstock, a section to maximize the conversion of a light hydrocarbon feedstock, and a section to provide discrete regulation of the heat supplied to the common line, in which the light hydrocarbon pyrolysis gas is quenched and the partially cracked heavy hydrocarbon effluent is further cracked to the desired level of conversion.

Conventional quenching methods and a conventional separation system are also provided to complete the process.

DESCRIPTION OF THE DRAWINGS

The invention will be better understood when viewed in combination with the drawings wherein.

DESCRIPTION OF THE PREFERRED EMBODIMENT

As has been previously indicated, the process of the present invention is directed to provide a means for cracking heavy hydrocarbon feedstock without the need for the large amount of dilution steam. Previously, this large steam requirement was necessary to provide the partial pressures required to suppress coke formation in the radiant section of the cracking furnace. The heavy hydrocarbon feedstocks contemplated are naphtha, kerosene, atmospheric gas oil, vacuum gas oil and resid. Further, the process of the invention is capable of being performed in conventional furnace apparatus, however, as will be seen, a furnace uniquely suited and specifically designed for the process of the present invention is also provided. The process of the invention is conveniently characterized as "DUOCRACKING".

Figure 1:
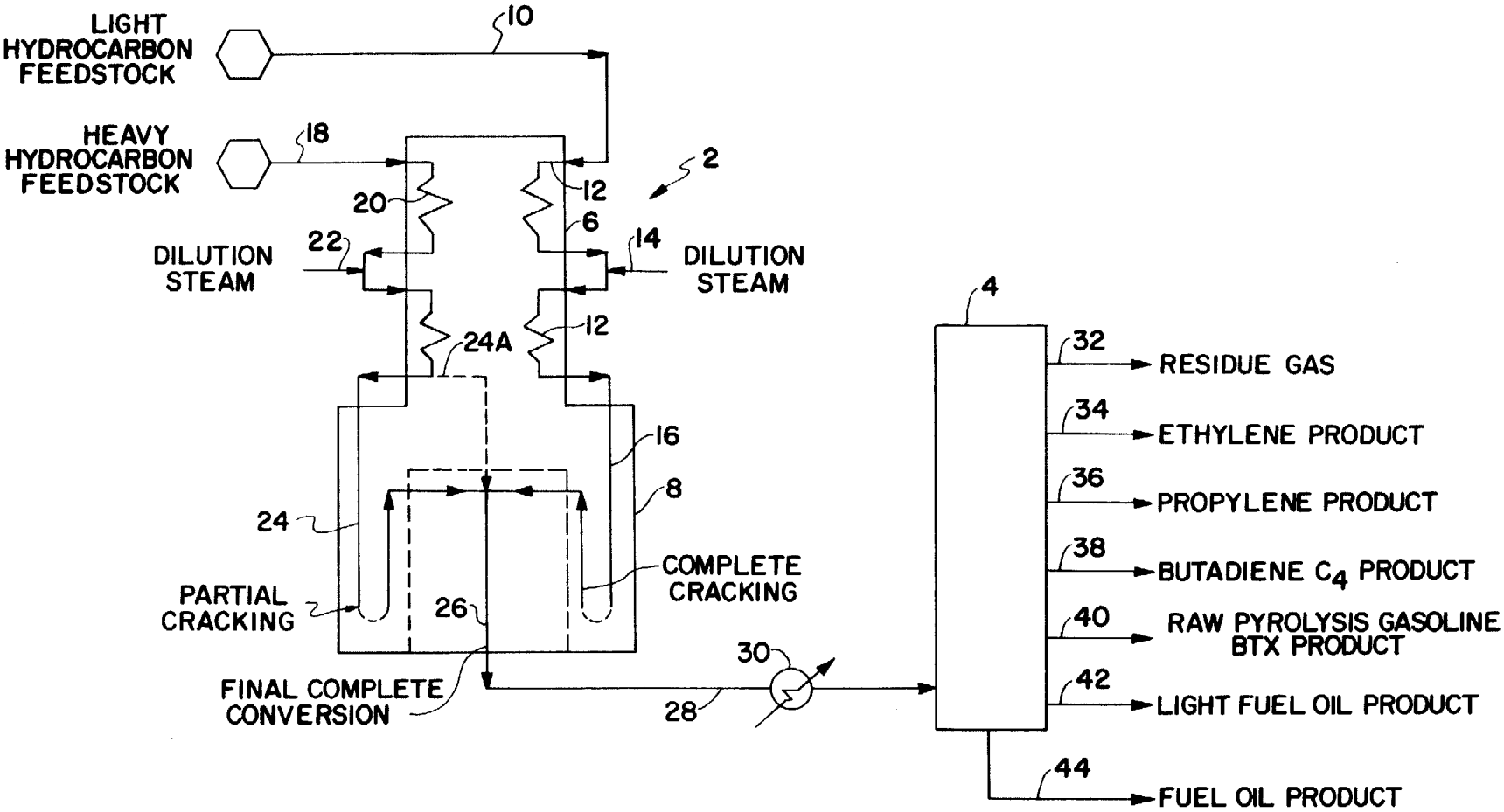
FIG. 1 is a schematic diagram of the process of the present invention shown as adapted for application using a conventional pyrolysis furnace.

As best seen in FIG. 1, a conventional furnace 2 comprised of a convection zone 6, and a radiant zone 8, is provided with convection and radiant section lines capable of performing the process of the present invention.

The convection zone 6 of the present invention is arranged to receive a feedstock inlet line 10 for the light hydrocarbon feedstock and an inlet line 18 for a heavy hydrocarbon feedstock. Coils 12 and 20 through which the light hydrocarbon feedstock and heavy hydrocarbon feedstock pass respectively are located in the convection zone 6 of the furnace 2. Lines 14 and 22 are provided to deliver dilution steam to the convection coils 12 and 20, respectively.

The radiant zone 8 is provided with coils 16 for cracking the light hydrocarbon feedstock to high conversion, and coils 24 for partially cracking the heavy hydrocarbon feedstock. A common coil 26 is also provided in which the heavy hydrocarbon feedstock is cracked to high severity by any one of the four modes explained earlier and the effluent from the light hydrocarbon is in effect, quenched to terminate the reactions. An effluent discharge line 28 is provided and conventional quench equipment such as a USX (Double Tube Exchanger) and/or a TLX (Multi-Tube Transfer Line Exchanger) are afforded to quench the cracked effluent.

The system also includes a separation system 4 which is conventional. As seen in FIG. 1, the separation system 4 is adapted to separate the quench effluent into residue gas (line 32), ethylene product (line 34) propylene product (line 36) butadiene/$C_4$ product (line 38), raw pyrolysis gasoline/BTX product (line 40), light fuel oil product (line 42), and fuel oil product (line 44).

Optionally, a line 24A is provided to deliver the partially cracked heavy hydrocarbon directly from the convection coil 20 to the common line 26. Under certain conditions, the heavy hydrocarbon can be partially cracked in convection zone 6 thereby rendering further cracking in the radiant zone unnecessary.

In essence, the process of the present invention is conducted by delivering a light hydrocarbon feedstock such as ethane, propane, normal and iso-butane, propylene, mixtures thereof, raffinates or naphthas through line 10 to the convection coils 12 in convection section 6 of furnace 2. Heavy hydrocarbon feedstock such as naphtha, kerosene, atmospheric gas oil or vacuum gas oils are delivered through line 18 to the convection coils 20.

Dilution steam is delivered by line 14 to convection coils 12 through which the light hydrocarbon feedstock is being passed. It is preferable that the dilution steam be superheated steam at temperatures in the range of 800° F. to 1000° F. The dilution steam is mixed with the light hydrocarbon feedstock at approximately 0.3 to 0.6 pound of steam per pound of feedstock. The composite of light feedstock and dilution is elevated in temperature to approximately 1000° F. to 1200° F. in convection section 6. Thereafter, the heated hydrocarbon is passed through coil 16 in radiant section 8 of furnace 2. In the radiant section, the light hydrocarbon feedstock is preferably cracked under high severity conditions to temperatures between 1500° F. and 1700° F. at residence times of about 0.1 to 0.3 seconds.

At the same time, the heavy hydrocarbon feedstock is delivered through line 18 to convection coils 20 in convection zone 6 of furnace 2. Dilution steam is delivered by line 22 to convection coils 20 to mix with the heavy hydrocarbon in a ratio of about 0.15 to 0.20 pound of steam per pound of hydrocarbon. The mixture is elevated to a temperature between 850° F. and 1200° F.—preferably 900° F. and 1000° F. convection zone 6 of furnace 2. Thereafter, heavy hydrocarbon feedstock from convection section 6 is delivered to radiant coils 24 wherein it is partially cracked under low to medium severity conditions to a temperature of about 1250° F. to 1450° F. at residence times of about 0.05 to 0.20 seconds.

The partially cracked heavy hydrocarbon feedstock is delivered to the common line 26 and the completely cracked light hydrocarbon pyrolysis gas from line 16 is also delivered to common line 26. In common line 26, the completely cracked light feedstock effluent provides heat to effect more complete cracking of the partially cracked heavy hydrocarbon. Concomitantly, the light hydrocarbon feedstock effluent is quenched by the lower temperature partially cracked heavy hydrocarbon feedstock in common line 26. The composite mixture is further cracked, then quenched in conventional quench equipment and thereafter separated into the various specific products.

Figure 2:
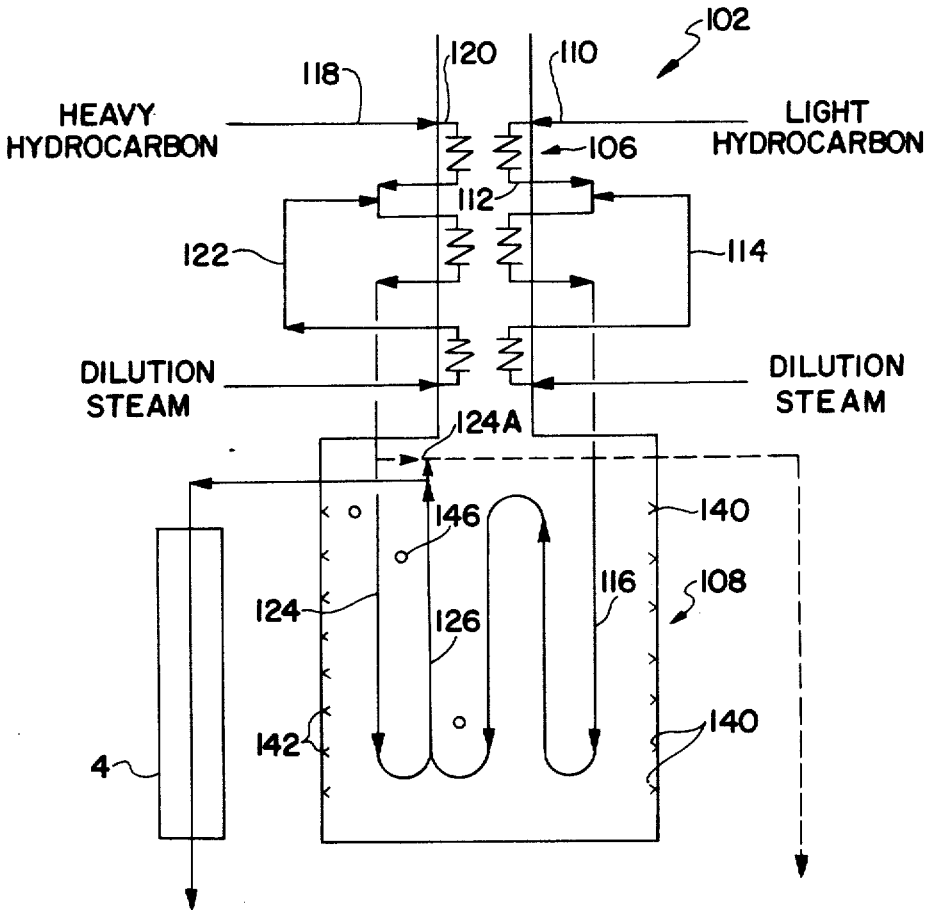
FIG. 2 is a schematic drawing of a furnace specifically designed to crack light and heavy hydrocarbons in accordance with the process of this invention.

Furnace 102 of FIG. 2 has been developed particularly for the process of the present invention. As in the conventional furnace, a connection zone 106 and a radiant zone 108 are provided. However, a separate coil 120 in the convection zone for the passage of heavy hydrocarbon is provided and a separate coil 112 for the passage of light hydrocarbon are also provided.

Radiant zone 108 is arranged with a radiant coil 116 and a plurality of burners 140 for high severity cracking of the light hydrocarbon feedstock. Practice has taught that coil 116 can be a multi-tube coil with the burners having a composite capacity of firing to achieve a conversion level of about 60 to 65% ethane, 85 to 95% propane, 90 to 95% $C_4$'s, 95 to 98% of raffinate or light naphtha conversion. A short coil of 116 will provide a low residence time but higher coil outlet temperature. Such a short coil will enhance selectivity. A longer coil of 116 which can bring about the above-mentioned conversions of lighter components can also be used to provide a lower coil outlet temperature. Either of them can be used to advantage as is known to those who are well versed in this art.

An array of radiant burners 140 will provide the necessary heat to bring about high severity cracking of the light hydrocarbon in coils 116.

Radiant section 108 is also provided with a coil 124 for partial cracking of the heavy hydrocarbon which can be a single tube. An array of burners 142 will provide the heat necessary to partially crack the heavy hydrocarbon.

An array of burners 146 located opposite common tube 126 will provide discrete heating of common tube 126 in which the heavy hydrocarbon is completely cracked and the light hydrocarbon effluent is quenched.

The heat available in the light hydrocarbon effluents now provide enthalpy for continued decomposition of heavy hydrocarbon. By selecting appropriate flow quantities of light and heavy hydrocarbon streams, the requisite amount of heat for the completion of heavy hydrocarbon decomposition can be provided.

However, tube 126 can now be discretely fired by burners 146 so as to provide additional heat needed over and above that supplied from the light hydrocarbon effluents.

Maintaining coil 126 inside the firebox environment provides an atmosphere for the heavy hydrocarbon to isothermally absorb the heat from the light effluents under controlled conditions. The heavy hydrocarbon which instantly reaches a higher temperature due to mixing is maintained at the mixed temperature of about 1400° F. for a short residence time of about 0.02 to 0.05 second to bring about the desired conversion level.

Maintaining coil 124A shadowed from direct radiation provides an atmosphere for heavy hydrocarbon to adiabatically absorb heat from light effluents. The successive introduction of light hydrocarbon cracked effluents into the heavy hydrocarbon stream in coil 124A, would also provide a controlled increasing temperature profile with respect to heavy hydrocarbon.

Higher conversion levels of heavy hydrocarbon are achieved by increasing the mixture temperature to 1500–1600° F. by adding additional heat if required by burners 146. Under these increased firing conditions, lower residence times of 0.01 to 0.02 seconds effect the complete conversion of the heavy hydrocarbons.

An example of the process of the present invention compared with a conventional process reveals the yield advantages of the invention. In the example, the following process conditions were maintained:

| | Conventional | DUOCRACKING | |
|---|---|---|---|
| Feedstock | Kuwait gas oil 100 lbs/hr equivalent | Kuwait gas oil 100 lbs/hr (line 18) equivalent Ethane 59 lbs/hr (line 10) | |
| Gas Oil | | | |
| Cracking Severity* | 2.2 | 2.2 | |
| Convection Exit | | (line 20) | (line 12) |
| Temperature | 1050° F. | 1000° F. | 1160° F. |
| Dilution Steam lb/lb Hydrocarbon | 1.07 | 0.18 | 0.5 |
| Radiant Zone | | | |
| | | (line 24) | (line 16) |
| Residence Time | 0.3 sec | 0.1 | 0.25 |
| Exit Temperature | 1480° F. | 1453° F. | 1525° F. |
| Supplementary Dilution | | | |
| lb of cracked Ethane + Steam/lb of heavy gas oil | 0.0 | 0.89 (line 26) | |
| Total Dilution lb/lb of heavy gas oil | 1.07 | 1.07 | |
| DUOCRACKING Coil | | | |
| Residence Time | | 0.06 | |
| Exit Temperature | | 1525° F. | |
| Yields, Wt % of HGO | | | |
| $CH_4$ | 12.5 | 13.0 | |
| Ultimate $C_2H_4$ | 23.0 | 26.4 | |
| $C_3H_6$ | 13.0 | 13.2 | |
| $C_4H_6$ | 3.5 | 2.6 | |
| Total Olefins | 39.5 | 42.2 | |
| $C_5$-400 F | 16.1 | 14.3 | |
| BTX | 9.7 | 10.1 | |
| 400 F+ | 25.9 | 24.4 | |

*Defined as kinetic severity function, analytical

The DUOCRACKING yield data reported in the Example are only the gas oil contributions in the combined cracking process. The ethane contribution was obtained by allowing the ethane to crack under identical process conditions as the mixture. The ethane contribution was then subtracted from the mixture yields to obtain only the gas oil contribution under DUO-CRACKING process conditions.

What is claimed:

1. A process for the thermal cracking of heavy hydrocarbon feed selected from the group consisting of naphtha, kerosene, atmospheric gas oil, vacuum gas oil and resid to produce olefins comprising:

(a) diluting the heavy hydrocarbon feed with steam in a ratio of 0.2 or less pound of steam per pound of heavy hydrocarbon;

(b) elevating the temperature of the heavy hydrocarbon with the steam diluent to a temperature to effect partial thermal cracking;

(c) mixing a stream of light hydrocarbon feedstock selected from the group consisting of ethane, propane, propylene, normal and iso-butane, raffinates and naphthas, or their mixtures, which light hydrocarbon is lighter than the heavy hydrocarbon feed with steam diluent;

(d) thermally cracking the light hydrocarbon feedstock to completion to produce principally olefins;

(e) delivering the completely cracked light hydrocarbon effluent to the stream of partially cracked heavy hydrocarbon to form a composite stream, said light hydrocarbon effluent providing heat for subsequent cracking and serving as a diluent for the partially cracked heavy hydrocarbon;

(f) further cracking the composite stream; and (g) quenching the effluent from the cracked composite stream of heavy and light hydrocarbon to terminate the reactions.

2. A process as in claim 1 wherein diluent steam is delivered to the light hydrocarbon stream in a ratio of from 0.3 to 0.6 pound of steam per pound of light hydrocarbon.

3. A process as in claim 2 wherein the diluent steam is superheated steam having a temperature in the range of 365° F. to 1000° F.

4. A process as in claim 1 wherein the light hydrocarbon is cracked at high severity short residence time cracking conditions at temperatures between 1500° F. and 1700° F. at residence times of about 0.1 to 0.3 seconds.

5. A process as in claim 1 wherein the heavy hydrocarbon is partially cracked at medium severity cracking conditions at temperatures of about 1250° F. to 1450° F. at residence times of about 0.05 to 0.20 seconds.

6. A process as in claim 1 wherein the heavy hydrocarbon is elevated to a temperature of about 1000° F. in the convection zone of a pyrolysis furnace; the light hydrocarbon is heated to about 1200° F. in the same pyrolysis furnace convection zone; the light hydrocarbon is cracked to its maximum possible conversion in the radiant zone of the pyrolysis furnace; and the completely cracked light hydrocarbon and the heavy hydrocarbon from the convection zone are delivered to a common line wherein the heavy hydrocarbon is subsequently cracked to desired completion.

* * * * *